United States Patent [19]

Yoshida et al.

[11] 4,272,067

[45] Jun. 9, 1981

[54] APPARATUS FOR HOLDING STACK OF SHEETS IN SHEET COUNTING MACHINE

[75] Inventors: Minoru Yoshida; Junichi Arikawa, both of Tokyo, Japan

[73] Assignee: Laurel Bank Machine Co., Ltd., Tokyo, Japan

[21] Appl. No.: 105,293

[22] Filed: Dec. 19, 1979

[30] Foreign Application Priority Data

Dec. 22, 1978 [JP] Japan ..... 53-159636

[51] Int. Cl.[3] ..... B65H 3/10; B65H 3/42; B65H 1/24

[52] U.S. Cl. ..... 271/95; 188/83; 235/92 SB; 271/160; 271/162

[58] Field of Search ..... 271/95, 160, 162, 127, 271/126, 30 A; 235/92 SB; 188/83, 130; 16/49; 414/330, 118; 221/60

[56] References Cited

U.S. PATENT DOCUMENTS

| | | | |
|---|---|---|---|
| 1,441,578 | 1/1923 | Hartford | 188/130 |
| 1,494,482 | 5/1924 | Hornburg | 188/130 |
| 3,652,081 | 3/1972 | Hatanaka et al. | 271/95 |

FOREIGN PATENT DOCUMENTS

| | | | |
|---|---|---|---|
| 47-1679 | 1/1972 | Japan | 235/92 SB |

*Primary Examiner*—Bruce H. Stoner, Jr.
*Attorney, Agent, or Firm*—Fleit & Jacobson

[57] ABSTRACT

In a machine for counting the number of sheets by bringing a stack of sheets in turn into abutment against a plurality of rotating suction heads, which are adapted to attract the sheets and deflect them one after another away from the remaining stack of sheets, an apparatus for holding the stack of sheets and adjusting the pressing force under which the stack of sheets is brought into abutment against the suction heads. The apparatus has a rotatable holder and a rotatable support rod for holding therebetween the stack of sheets. Associated with the holder and the support rod are two springs which present different tensile forces in opposite directions with respect to the holder and the support rod so that the pressing force may be determined by the effect of the tensile force difference between the tensile forces of the two springs. Also associated with the holder are resilient friction members for decreasing by their frictional action the effect of the tensile force difference, and adjusting members for adjusting the degree of the frictional action of the friction members.

3 Claims, 7 Drawing Figures

APPARATUS FOR HOLDING STACK OF SHEETS IN SHEET COUNTING MACHINE

BACKGROUND OF THE INVENTION

This invention relates to an apparatus for holding a stack of sheets, such as bank notes, in a sheet counting machine.

A known sheet counting machine for counting the number of sheets has a rotatable holder for holding thereon a stack of sheets, bank notes, for example, to be counted, and a plurality of rotary suction heads carried on a rotary cylinder for attracting the bank notes by suction and deflecting each sheet one after another away from the stack of bank notes. The stack of bank notes held on the holder must be pressed with a suitably selected pressing force against the suction heads so that the bank notes may be effectively attracted by the suction heads. If the pressing force of the stack of bank notes against the suction head is too strong, the stack will be repeatedly bounced on the suction head, causing undesirable noise and also premature wear of the suction heads. On the contrary, if the pressing force is too weak, the bank notes cannot have sufficient contact with the suction head, thus causing a considerable amount of air to be introduced into the suction head and thereby making the counting operation of the machine to be inefficient. Thus, the pressing force of the stack of bank notes against the suction heads must be adjusted to a suitable level. In the prior art sheet counting machine of such type, however, proper adjustment of the pressing force of the stack of sheets against the suction heads has been not easy to achieve, and such adjustments have had to rely on the skills of an experienced engineer.

SUMMARY OF THE INVENTION

It is therefore an object of the invention to provide an improved apparatus for holding a stack of sheets and pressing them against the suction heads in the above-mentioned type of sheet counting machine, whose pressing force of the stack of sheets against the suction heads can be easily adjusted to a suitably selected value, without requiring the aid of an experienced engineer.

According to the invention, a rotatable holder for holding thereon a stack of sheets is provided with a first spring which urges the holder in the direction toward a rotary cylinder carrying thereon a plurality of suction heads. A rotatable arm, which has on its free end a holding rod for holding the stack of sheets between the rod and the holder, is provided with a second spring which urges the rotatable arm in the direction away from the rotary cylinder. The holder is also provided with an adjustable resilient friction means which acts to frictionally obstruct or control the rotational motion of the holder. The pressing force of the stack of sheets against the suction heads can be adjusted to a desired value by adjusting the resilient friction means so as to provide a suitable frictional force against the holder.

DESCRIPTION OF THE DRAWINGS

Other objects and advantages of the present invention will become apparent from the following description made with reference to the accompanying drawings, in which.

DESCRIPTION OF THE PREFERRED EMBODIMENTS

Embodiments of the present invention will now be described in detail with the reference to the accompanying drawings. Reference being made to the accompanying drawings wherein similar parts are indicated by like numerals.

First, for better understanding of the invention, description will be made about a typical example of the sheet counting machine of the prior art in connection with FIGS. 1 and 2. In the following description, bank notes will be taken as an example of sheets to be counted by the machine.

Figure 1:
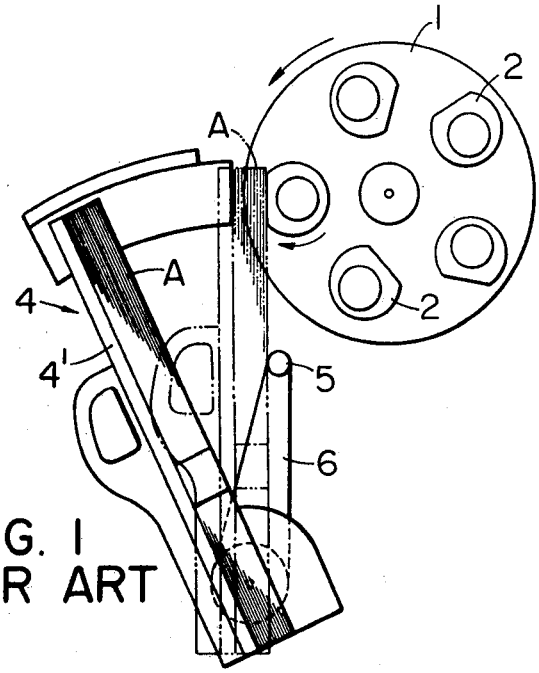
FIG. 1 PRIOR ART
FIG. 1 is a plan view showing a sheet counting machine of prior art.

Referring to FIG. 1, a cylinder 1, which rotates about its center axis, carries thereon a plurality of rotary suction heads 2 which are arranged in a circle and rotate respectively about their own axes. Thus, the suction heads 2 rotate about their own axes while revolving about the center axis of the rotating cylinder 1. A rotatable holder 4, on which a stack of bank notes A to be counted is placed in a vertical direction, is driven toward the cylinder 1 thereby bringing, with a pressing force, the surface of the outermost bank note A in the stack into abutment against one of the suction heads 2, as shown by the dot-bar line in FIG. 1, thereby causing this bank note A to be suckedly attracted to the suction head 2 by suction. At this time, if the pressing force of the stack of bank notes A against the suction heads 2 is too sharp, then the stack of bank notes A will repeatedly bounce on the suction heads 2, causing undesirable mechanical noise and also premature wear of the suction heads 2. On the contrary, if the pressing force is too weak, the surface of bank note A cannot have sufficient contact with the suction head 2, and air is introduced into the suction head 2. As a result, the degree of vacuum for a vacuum switch (not shown), which serves to drive the cylinder 1, is decreased and this switch is turned off, causing the cylinder 1 to be stopped.

Figure 2:
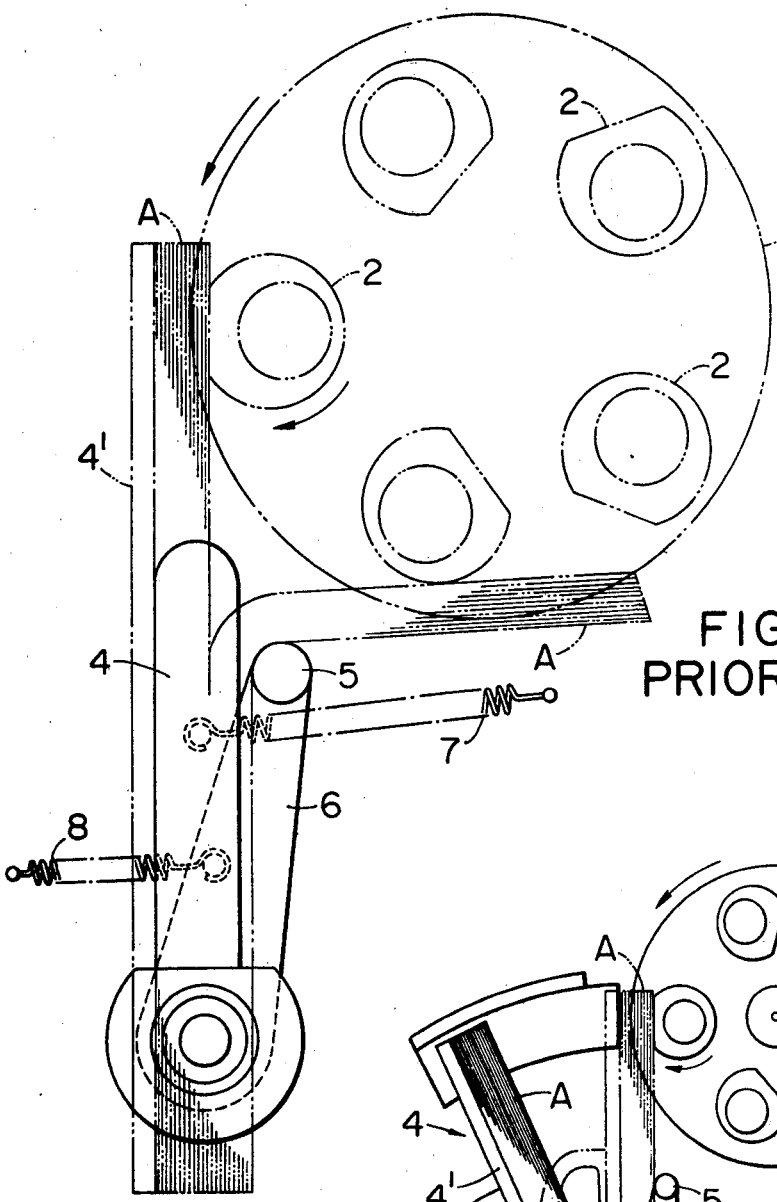
FIG. 2 PRIOR ART
FIG. 2 is an enlarged plan view showing the state of operation of the machine of FIG. 1.

More particularly, reference being made to FIGS. 1 and 2, when a stack of bank notes A is placed on the holder 4, the holder 4 is rotated toward the rotary cylinder 1 by a driving device (not shown). With this rotation of the holder 4, the stack of bank notes A placed on the holder is held between an upstanding side plate 4', which extends upwardly at a right angle from the upper surface of the holder 4, and a support rod 5 which is mounted on the free end of a rotatable arm 6. The surface of the outermost bank note A of the stack is brought into abutment against one of the suction heads 2 on the cylinder 1. Accordingly, the suction part of this suction head 2 is closed by the bank note A, and thus the degree of vacuum for the above-mentioned vacuum switch is increased to turn this switch on thereby starting the cylinder 1 rotating and then beginning the counting operation.

The pressing force of the bank note A against the suction head 2 is given by the difference between the tensile force of a first spring 7, which urges the rotatable holder 4 toward the cylinder 1, and the tensile force of a second spring 8 which urges the rotatable arm 6 and accordingly the support rod 5 in the direction away from the cylinder 1. The first spring 7 is designed to present a larger tensile force than that of the second spring 8 so that the holder 4 may be driven toward the cylinder 1 to bring the stack of bank notes A into abutment against the suction heads 2, under a substantially constant pressing force throughout the counting operation of the machine.

In such construction of the prior art, however, setting the tensile force difference between the first spring 7 and the second spring 8 to a desired value has required a delicate adjusting technique and has had to rely on the aid of an experienced engineer.

Such problems in the prior art have been successfully solved by the present invention. The invention will now be described in detail in conjunction with the remaining drawings. In the drawings, similar parts as those in FIGS. 1 and 2 are indicated by like numerals, and accordingly detailed description thereof will be omitted.

Referring to FIGS. 3 to 6, a holder 4 is mounted for rotation about a support shaft 10 which is installed near a rotary cylinder 1 (see FIG. 1). Also mounted for rotation about the shaft 10 is an arm 6 having a holding rod mounted on the free end thereof. Connected to one end portion of the holder 4 is one end portion of a link member 11 is a manner to be described hereinbelow. The other end portion of the link member 11 is rotatably connected to a pin 13 which in turn is eccentrically mounted on a cam 12 which is rotated in the direction of arrow by a driving motor (not shown). Thus, with the cam 12 rotating in the direction of the arrow, the holder 4 will make a swing motion about the support shaft 10.

The manner of connecting the link member 11 to the holder 4 will now be described in detail. Formed in the one end portion of the link member 11 is an elongated slot 14 through which loosely passes a pin 15 which is mounted on one end portion of the holder 4. Disposed about the pin 15 are friction members 16 and 17 which are made of a resilient frictional material, such as rubber or felt, for example. The member 16 is disposed above the link member 11, and the member 17 is disposed between the link member 11 and the holder 4 is contact therewith. The top portion of the pin 15 is threaded in its periphery, and has a washer 18 disposed thereabout and two or double nuts 19, 19 threaded thereto above the washer 18. Thus, by turning the nuts 19, 19 to squeeze the friction members 16 and 17 to a suitable extent, the link member 11 can be press held between the friction members 16 and 17 against the holder 4 in a resiliently frictional manner. The frictional resistant force S against the link member 11 due to the friction members 16 and 17 is so set that the force S is weaker than the tensile force difference R between the tensile force P of the first spring 7 and the tensile force Q of the second spring 8 (i.e. R=P–Q), and is sharper than the abutting force of the stack of bank notes A against the suction head 2 which appears during a counting operation. The pressing force of the stack of bank notes A against the suction head 2 appearing when the stack of bank notes A abuts against the suction head 2 is equal to the difference between the tensile force difference R and the frictional resistant force S (i.e. R–S).

Reference numerals 20 and 21 indicate switches which are adapted to be operated according to rotation of the cam 12 in the direction of arrow thereby stopping a driving motor (not shown). Reference numeral 22 indicates a stopper for limiting rotation of the rotatable arm 6.

Adjustment of the friction members 16 and 17 will now be described. This adjustment of the friction members 16 and 17 is made in relation to the value of the tensile force difference R (i.e. P–Q) between the tensile forces of the first and second springs 7 and 8. When the value of the tensile force difference R is large, then the nuts 19, 19 are so turned as to squeeze the friction members 16 and 17 more tightly to increase the frictional resistant force S against the link member 11 thereby to adjust the pressing force T (i.e. R–S) of the stack of bank notes A against the suction heads 2 to a suitable value. On the contrary, when the value of the tensile force difference R is small, then the nuts 19, 19 are turned so as to lessen the squeeze of the friction members 16 and 17 to decrease the frictional force S against the link member 11 thereby adjusting the pressing force T to the suitable value.

Figure 3:
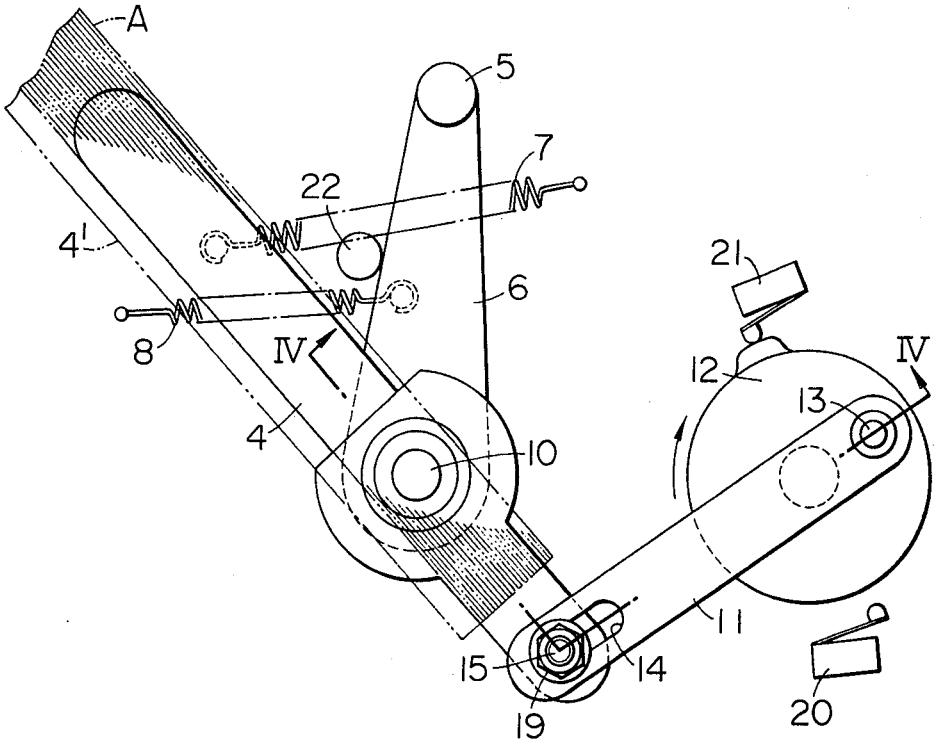
FIG. 3 is a plan view of an apparatus according to the invention showing the state wherein a stack of bank notes is placed on the holder.
Figure 4:
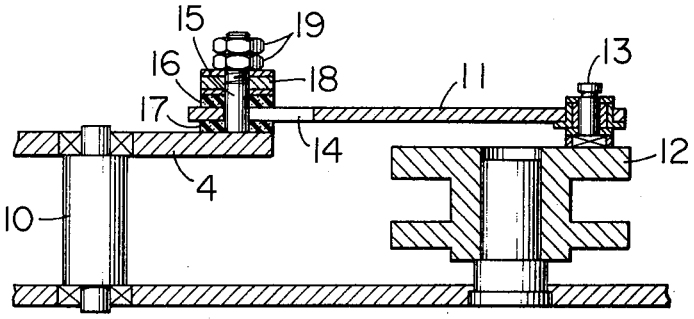
FIG. 4 is a sectional view taken along line IV—IV of FIG. 3.
Figure 5:
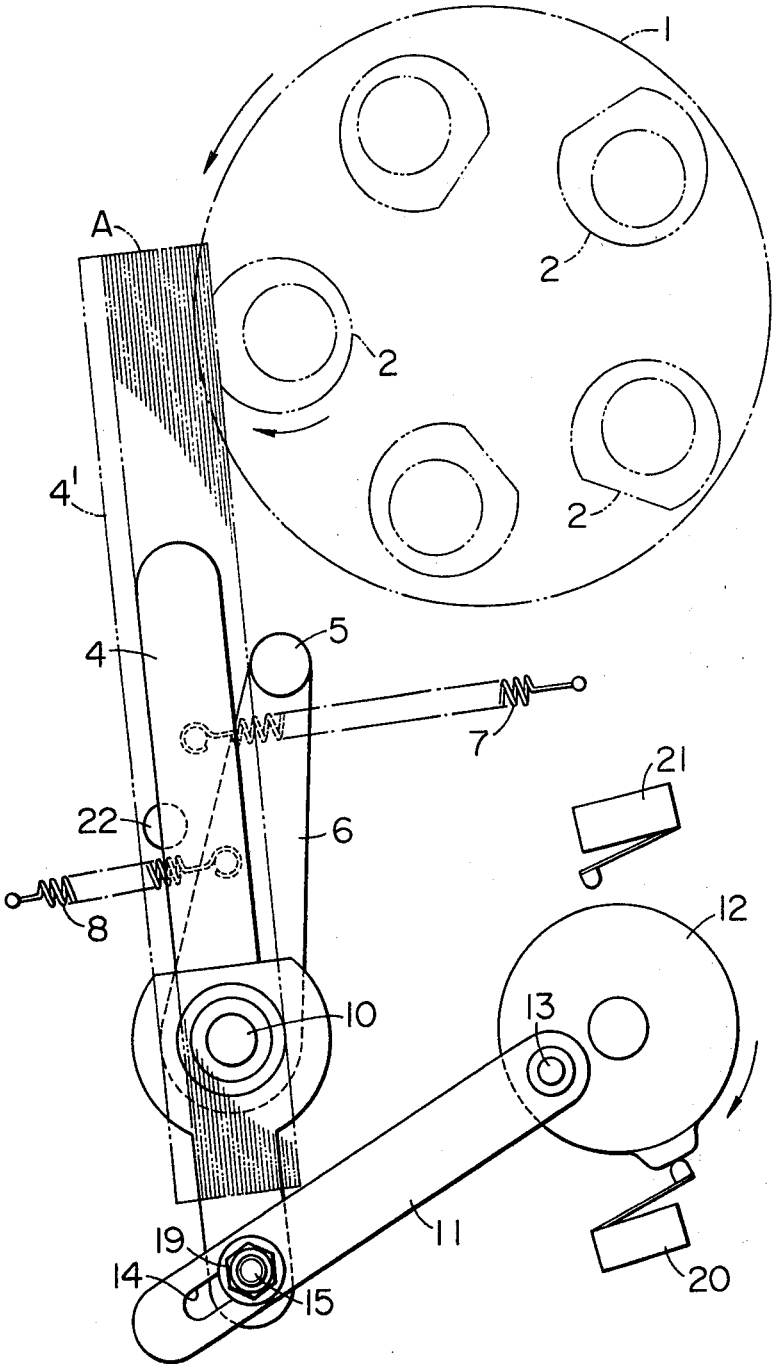
FIG. 5 is an enlarged plan view of the apparatus of FIG. 3 showing the state immediately before the start of a counting operation.
Figure 6:
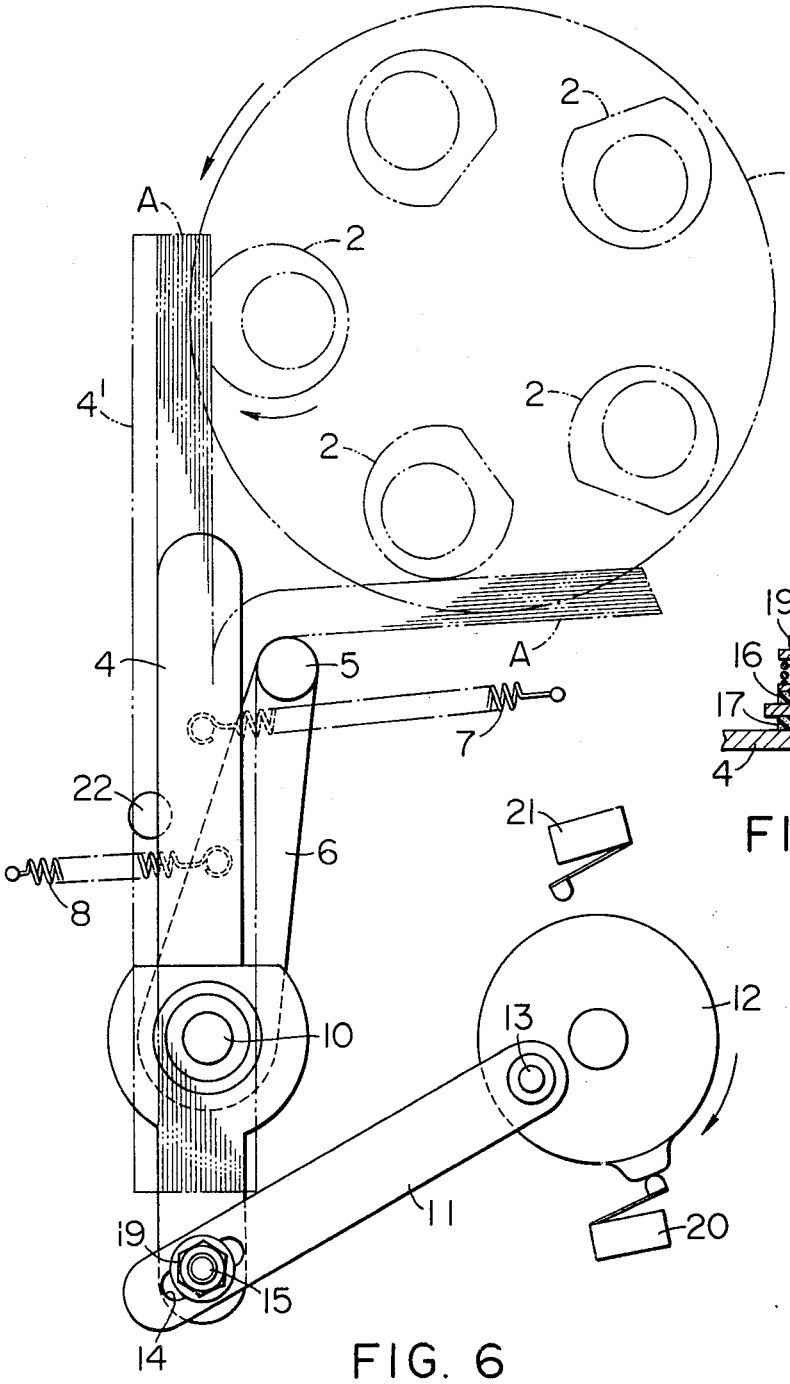
FIG. 6 is a plan view similar to FIG. 5 showing the state during operation of counting the bank notes.

Operation of the above-described apparatus of the invention will now be described. When a stack of bank notes A is placed on the holder 4 as shown in FIG. 3, this stack of bank notes A is detected by a photoelectric detector (not shown) which issues a detection signal to start a driving motor (not shown). By this, the cam 12 is rotated in the direction of arrow, and the holder 4 is rotated, through the link member 11, about the support shaft 10 toward the cylinder 1 thereby holding the stack of bank notes A between the side plate 4' of the holder 4 and the support rod 5. When the cam 12 has rotated about 180°, the switch 20 is operated by the cam 12, as shown in FIG. 5, to stop the driving motor and the holder 4 stops its rotation. Upon this, the bank notes A of the stack placed on the holder 4 are attracted one after another by the suction heads 2 which are rotating about their own axes while revolving about the center axis of the cylinder 1 which is rotated about its axis in the direction of the arrow, thus counting of the bank notes A being made in the same manner as in the prior art. With the bank notes A being deflected or turned over, during such counting operation, one after another away from the stack, the holder 4 is further rotated toward the rotating cylinder 1, against the frictional resistant force S due to the friction members 16 and 17 acting against the link member 11, by the tensile force difference R between the two springs 7 and 8, as shown in FIG. 6. Accordingly, the stack of bank notes A abuts against the suction heads 2 under the pressing force T which is given by the difference between the tensile force difference R and the frictional resistant force S (i.e. R–S). During such rotation of the holder 4, the elongated slot 13 allows the link member 11, together with the friction members 16 and 17 attached thereto, to move therealong. As seen in FIG. 6, if the abutting force of the stack of bank notes A against the suction heads 2 exceeds the above-mentioned pressing force T (i.e. R–S) during the counting operation, the frictional resistant force S due to the friction members 16 and 17 will act to prevent the holder 4 from rotating in the direction away from the rotating cylinder 1. When the counting of the bank notes has finished, the cylinder 1 stops its rotation, and the driving motor is restarted to rotate the cam 12 in the direction of the arrow, whereby the holder 4 is rotated in the direction away from the cylinder 1 to regain its original position shown in FIG. 3. After this, the cam 12 operates the switch 21 to stop the driving motor, thus all the parts return to their original states as shown in FIG. 3.

Figure 7:
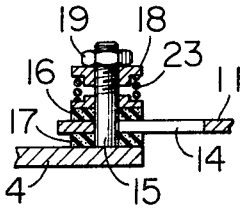
FIG. 7 is a side view showing the essential portion of another embodiment of the invention.

FIG. 7 shows another embodiment wherein a spring 23 is interposed between the friction member 16 and the nut 19 or the washer 18. With such a construction, finer adjustment of the frictional resistant force S due to the friction members 16 and 17 against the link member 11 can be made as compared with the first embodiment wherein squeezing of the friction members has been made only by nut 19.

While, in the above embodiments, the friction members 16 and 17 are so arranged that they hold therebetween the link member 11, the invention is not limited to this. For example, the friction members 16 and 17 may be so arranged that they hold therebetween the holder 4.

While, in the above, description has been made by taking bank notes as an example, it is needless to say that the invention can be applied to various sorts of bendable sheets.

As will be apparent from the above description, according to the invention, adjustment of pressing force of a stack of sheets abutting against the suction heads to a desired value can easily be made by adjusting the frictional resistant force of the friction members by simple rotating the nut, while the aid of an experienced engineer is no longer required. Furthermore, such pressing force can be maintained at a constant value throughout the counting operation, thus correct and smooth operation of counting sheets can be obtained.

While, in the above, the invention has been described in connection with the preferred embodiments thereof, the invention is not limited to this and various changes and modifications can be made without departing from the spirit and the scope of the invention.

What is claimed is:

1. In a machine for counting a number of sheets wherein a stack of sheets to be counted is brought in turn into abutment against a plurality of rotary suction heads carried on a rotary cylinder whereby the sheets are attracted by the suction heads through suction and deflected one sheet after another away from the remaining stack of sheets, an apparatus for holding the stack of sheets comprising: a holder for holding the stack of sheets, said holder being rotatable in the direction toward and departing away from said cylinder for bringing the stack of sheets in turn into abutment against the suction heads; a first spring for urging said holder in the direction toward said cylinder; a support rod for holding the stack of sheets between the support rod and the holder; a second spring for urging the support rod in the direction away from said cylinder; said first spring presenting a larger tensile force than that of said second spring to subject the stack of sheets held between said holder and the support rod to the effect of the tensile force difference between the tensile forces of said first and second spring; friction means adapted to decrease by the frictional action thereof the effect of said tensile force difference; adjustment means for adjusting the degree of the frictional action of said friction means; a rotating cam adapted to drive and stop driving said rotatable holder; and a link member interconnecting said cam and a free end portion of said holder, said link member having in an end portion thereof an elongated slot for connection with said free end portion of the holder in such a manner that said free end portion of the holder is permitted to move along said elongated slot; wherein said friction means and said adjustment means are provided for the interconnecting portion of said holder and said link member.

2. An apparatus according to claim 1 wherein said friction means includes at least one resilient frictional member interposed between said holder and said link member; and said adjustment means includes a pin which is mounted on said holder and extends passing through said friction member and through said elongated slot of the link member, and at least one nut which is threaded on the top portion of said pin for adjustingly squeezing said resilient frictional member.

3. An apparatus according to claim 2 wherein said adjustment means includes spring mounted between said nut and said holder thereby presenting pressure against said resilient frictional member.

* * * * *